US012791248B2

(12) United States Patent
Mayr et al.

(10) Patent No.: US 12,791,248 B2
(45) Date of Patent: Nov. 10, 2026

(54) HOUSEHOLD COOLING APPLIANCE WITH PLATE-LIKE SEPARATION UNIT, WHICH IS CONFIGURED AS MULTI-MODULE CARRIER PLATE

(71) Applicant: BSH Hausgeräte GmbH, Munich (DE)

(72) Inventors: Tobias Mayr, Gundelfingen an der Brenz (DE); Altug Karabas, Ulm (DE)

(73) Assignee: BSH Hausgeräte GmbH, Munich (DE)

( * ) Notice: Subject to any disclaimer, the term of this patent is extended or adjusted under 35 U.S.C. 154(b) by 104 days.

(21) Appl. No.: 18/818,905

(22) Filed: Aug. 29, 2024

(65) Prior Publication Data

US 2025/0085046 A1 Mar. 13, 2025

(30) Foreign Application Priority Data

Sep. 8, 2023 (TR) ..... TR2023/011184

(51) Int. Cl.
*F25D 27/00* (2006.01)
*F25D 23/06* (2006.01)
*F25D 29/00* (2006.01)

(52) U.S. Cl.
CPC ..... *F25D 27/005* (2013.01); *F25D 23/069* (2013.01); *F25D 29/003* (2013.01); *F25D 2201/12* (2013.01); *F25D 2400/361* (2013.01); *F25D 2700/00* (2013.01)

(58) Field of Classification Search
CPC ..... F25D 23/069; F25D 27/00; F25D 2317/0417; F25D 2400/36
See application file for complete search history.

(56) References Cited

U.S. PATENT DOCUMENTS 5,419,148 A * 5/1995 Kuehl ..... F25D 29/005 62/130
5,425,245 A 6/1995 Martin et al.
6,006,531 A * 12/1999 Pritts ..... F25D 17/045 236/DIG. 19
6,779,357 B1 8/2004 Fann
8,135,482 B2 * 3/2012 Caldwell ..... G09F 3/204 211/119.003
10,371,438 B2 * 8/2019 Ammerman ..... F21V 33/0044
2002/0002839 A1 * 1/2002 Sessa ..... F25D 23/069 312/401
2012/0140440 A1 6/2012 Dam et al.
2017/0219269 A1 * 8/2017 Ahn ..... F25D 21/02

FOREIGN PATENT DOCUMENTS

CN 116105430 A * 5/2023 ..... F25D 11/02
EP 2131128 B1 6/2013

* cited by examiner

*Primary Examiner* — Lionel Nouketcha
(74) *Attorney, Agent, or Firm* — Laurence A. Greenberg; Werner H. Stemer; Ralph E. Locher

(57) ABSTRACT

A household cooling appliance contains a housing and a receiving space for food configured in the housing. A plate-like separation unit is releasably arranged in the receiving space and is arranged for separating the volume of the receiving space. The separation unit has a base plate, which contains a clearance, which is filled with thermally insulating material, and in the base plate at least one light module is arranged as a function module. The base plate is configured as a multi-module carrier plate for receiving several functionally different function modules. Wherein on the base plate is arranged a further electronics module that is separate and functionally different from the light module.

18 Claims, 7 Drawing Sheets

HOUSEHOLD COOLING APPLIANCE WITH PLATE-LIKE SEPARATION UNIT, WHICH IS CONFIGURED AS MULTI-MODULE CARRIER PLATE

CROSS-REFERENCE TO RELATED APPLICATION

This application claims the priority, under 35 U.S.C. § 119, of Turkish Patent Application TR 2023/011184, filed Sep. 8, 2023; the prior application is herewith incorporated by reference in its entirety.

FIELD AND BACKGROUND OF THE INVENTION

One aspect of the invention relates to a household cooling appliance containing a housing and a receiving space for food configured in the housing. The household cooling appliance moreover contains a plate-like separation unit. Same is releasably arranged in the receiving space and is arranged for volume separation of the receiving space. The separation unit contains a base plate. Same comprises a clearance, which is filled with thermally insulating material. Moreover, in the base plate a light module is arranged as function module of the household cooling appliance.

Such plate-like separation units are known from the prior art. For instance, in European patent EP 2 131 128 B1 such a plate is arranged in a cooling compartment of a household cooling appliance. The divisional plate contains a light element.

By such divisional plates it is moreover also facilitated that they serve as deposit plate, on the top surface of which objects, as well as food, can be placed. Thus, such divisional plates are also multi-functional units, which in this regard may be used in manifold ways.

SUMMARY OF THE INVENTION

It is the object of the present invention to provide a household cooling appliance, in which the capability of the household cooling appliance of being equipped is expanded.

This object is solved by a household cooling appliance which comprises the features according to the independent claim.

With the foregoing and other objects in view there is provided, in accordance with the invention, a household cooling appliance, containing a housing defining a receiving space for food and a plate-shaped separation unit being releasably disposed in the receiving space and is disposed for separating a volume of the receiving space. The plate-shaped separation unit has a base plate which has a clearance, which is filled with a thermally insulating material. The plate-shaped separation unit has in the base plate at least one light module configured as a function module. The base plate is configured as a multi-module carrier plate for receiving several functionally different function modules. A further electronics module is disposed on the base plate and is separate and functionally different from the at least one light module.

One aspect of the invention relates to a household cooling appliance containing a housing and a receiving space for food configured in the housing. The household cooling appliance moreover contains a plate-like separation unit. Same is releasably arranged in the receiving space and arranged for separation of the volume of the receiving space. The separation unit may also be referred to as divisional plate. The separation unit contains a base plate. Same contains a clearance, which is filled with thermally insulating material. Moreover, in the base plate a light module is arranged as a function module of the household cooling appliance.

A releasable mechanical connection is such connection, in which the separation unit may be non-destructively reversibly detached and attached again.

It is of the essence that the base plate of the separation unit is configured as multi-module carrier plate for receiving several, in particular functionally different function modules. On the base plate a further electronics module that is separate and functionally different from the light module is arranged.

The base plate is in particular a contiguous unit composed of individual separate elements.

Thus, the capability of the household cooling appliance of being equipped with various function units is expanded. In particular it is envisaged that especially the separation unit is configured as such multi-module carrier plate. Thus, locally on a specific unit of the household cooling appliance, which moreover is also removable and reinsertable, a plurality of at least two different separate electronic modules are arranged. Especially this separation unit in this connection is particularly advantageous. This is because by the design of the base plate, which is also configured as thermally insulating partition wall, same comprises a specific mechanical rigidity. Thus, it is particularly predestined to receive several other function modules. On the one hand, this is advantageous with regard to the mechanical load-bearing capacity of this base plate, on the other hand, due to the height of the design, namely the thickness equally particularly advantageously facilitated. This is because further electronics modules may thus be attached thereto in manifold ways, for instance on a bottom wall and/or also at least in part sunk in this base plate. Since the base plate with its setup thus also can receive such function modules in the interior at least in part, these are also arranged in protected manner and moreover, equally at least in part, can be attached in thermally shielded manner. Particularly also for this reason, the suggested solution according to the invention is very advantageous, if in particular this base plate is designed as a multi-module carrier plate.

In a possible embodiment, the base plate contains a bottom wall. The bottom wall contains a recess that is open towards the bottom. In same the light module may be arranged, in particular arranged to be sunk in at least in part. Preferably, this light module is arranged to be completely sunk in this recess. Light of this light module may be emitted through this opening towards the bottom. Thus, on the one hand, this light module is received in a space-saving manner in the base plate. Moreover, a very targeted and directed light emission towards the bottom is facilitated. Thus, it is also facilitated that in this regard openings may be configured to be larger and also in this connection larger light modules may be installed. An illumination of the subvolume of the receiving space configured below the base plate, in particular below the bottom wall, is therefore facilitated in a very comprehensive way. A very bright illumination of this subvolume is thereby achieved. In this way, the storage chamber, in particular a keep-fresh container for instance for vegetables, fruits or meat, is conveniently illuminated and the light module itself is hidden for the user, so that the visual appearance of the household cooling appliance is improved.

In a possible embodiment, the light module is preferably arranged in the front half of the base plate, so that the storage chamber is illuminated in the withdrawn state and in the drawn out state of a storage unit. The light module is preferably provided between a retaining element holding a closing unit, in particular a lid, provided at the front area of the base plate and a transmission unit with a drive unit retaining and moving the closing unit, in particular a lid, provided at the rear area on the bottom side of the base plate. In the installed state of the base plate, the front area of the base plate is closer to the access opening of the receiving space than the rear area of the base plate.

In a possible embodiment, the light module is not overlapping with the electronics module in vertical direction of the household cooling appliance. In this way, the thermally insulating material of the base plate is uniformly thick enough in horizontal extension of the base plate between an upper volume subspace and lower volume subspace, so that condensation on the base plate is properly avoided and the base plate may be provided thinner in height direction.

In a possible embodiment, the electronics module is an operating and/or display device. Thereby it is facilitated that the separation unit itself contains precisely such a specific design of an electronics module. The accessibility for a user for performing operational processes is advantageous. On the other hand, also the viewing of information represented on a display device is advantageous. By the commonly exposed position of the separation unit in the receiving space, namely for the separation of volume, the base plate is also visible and viewable. Thus, this very arrangement of an operating and/or display device in this base plate is in this regard advantageous. The operating and/or display device may be provided for inputting of operating parameters and for outputting of operating parameters. In particular, the operating and/or display device could have at least one output unit, which could be provided at least for outputting in an optical manner. The household cooling appliance could in particular have a control unit, which could be provided in particular at least to control and/or regulate a drive unit for ventilation of a storage chamber. In particular, the control unit could be provided to activate the drive unit as a function of operator input by the operating and/or display device and in particular to set a position of a closing unit relative to a storage unit of the storage chamber by the drive unit.

In a possible embodiment, the base plate contains a ceiling wall. This ceiling wall preferably comprises a recess, which is open towards the top and in which the electronics module is arranged to be sunk in, such that the electronics module is can be viewed from the top. Thus, on the one hand, accessibility of the electronics module is very simple, on the other hand, the capability of the electronics module to be perceived is also comprehensively given. This is advantageous in particular if the electronics module is an operating and/or display device.

In an embodiment, the base plate contains a ceiling wall made of glass. The electronic module may be located in a cut-out of the ceiling wall made of glass. The glass may be configured to be transparent at least in part. However, it may also be stained in part.

In a possible embodiment, on the base plate a yet further function module is arranged. In particular then at least three different electronics modules are arranged on this multi-module carrier plate.

In a possible embodiment, the electronic module may be a drive unit for driving a closing unit of the household cooling appliance that is external to the separation unit, wherein the closing unit is mechanically coupled to the transmission unit. Thus, in a very advantageous way, a local vicinity of the drive unit to the unit to be driven thereby can be achieved. Comprehensive systems transmitting the drive energy of the drive unit to the external closing unit, may then be saved.

In an embodiment, the drive unit is arranged on a bottom wall of the base plate. The drive unit is preferably provided at the rear side of the base plate. Thus, a particularly simple and short-path coupling to the closing unit, which is arranged below the separation unit and are to be moved, is facilitated. Moreover, the drive unit then is also arranged in a protected way. In particular it is then also possible that on a ceiling wall of the base plate objects may be attached otherwise, without the drive unit being an obstacle. The drive unit may be arranged sunk in in a recess of the bottom wall of the base plate, especially completely sunk in in a recess of the bottom of the base plate.

In a possible embodiment, a transmission unit is arranged on a bottom wall of the base plate. This transmission unit is configured for guiding the movement of a closing unit of the household cooling appliance that is external to the separation unit, wherein the closing unit is mechanically coupled to the transmission unit. Thereby, it is also facilitated that such external closing unit can be guided in a more precise way. This is because by the arrangement of the separation unit and its larger weight same is also positioned in a more stable and slide-proof manner. Therefore, no relative movements between the base plate and the external closing unit result, if this external closing unit is guided via the transmission unit, since the base plate in this connection then does not move. This embodiment is particularly advantageous if a drive unit is present on the separation unit, which exerts the original force for moving the external closing unit. This is because then through the additional transmission unit the guiding of this external closing unit stimulated in the movement is more precise.

In a possible embodiment, the closing unit is movable into different positions relative to a storage unit of the storage chamber by the drive unit over the transmission unit, so that different ventilation is provided in the storage chamber.

In a possible embodiment, the drive unit pivots the transmission unit about at least one pivot axis, in particular about just one pivot axis, relative to the storage chamber, to ventilate the storage chamber.

In particular, the storage unit forms at least one boundary wall of the storage chamber. The storage unit in particular has an at least substantially trough-like configuration. The storage unit forms in particular at least one refrigeration compartment. For example, the storage unit could form a chiller compartment and/or a vegetable compartment and/or a fruit compartment and/or a meat compartment and/or a keep-fresh compartment. An "upper face" of an object refers in particular to a face which faces away from a base in an installed position. The base could be in particular a bottom, in particular a floor and/or a storage surface, which could in particular be formed at least partially by the bottom.

In the first storage state the closing unit and the storage unit define the storage chamber at least substantially and advantageously completely taking into account at least one sealing tolerance. The closing unit is configured in particular as a lid. For example the closing unit could be configured as a single part and/or as a single piece. Alternatively the closing unit could be configured in at least two parts, in particular in two parts and/or multiple parts, with in particular individual parts, in particular elements and/or units of the closing unit, being able to be arranged at least substantially immovably relative to one another. The closing unit is in particular free of openings and/or cutouts, which are provided in particular to ventilate the storage chamber.

A drive unit is provided to pivot the closing unit relative to the storage unit in the second storage state and in particular to open the storage chamber at least partially by the pivot movement of the closing unit relative to the storage unit, in order to allow in particular an exchange of fluid, in particular an exchange of air, between the storage chamber and its surroundings. The drive unit distances the closing unit in at least one region, in particular in at least one side region, from the storage unit in particular in the second storage state.

In particular, the drive unit is provided to pivot the closing unit relative to the storage unit and in particular to arrange it in different positions relative to the storage unit. In particular the drive unit is provided to pivot the closing unit from the first storage state relative to the storage unit and in particular to move it to the second storage state. In particular the drive unit is provided to pivot the closing unit from the second storage state relative to the storage unit and in particular to move it to the first storage state.

In the first storage state the closing unit is arranged in particular in a first pivot position relative to the storage unit. In the second storage state the closing unit is arranged in particular in a second pivot position, which is different from the first pivot position, relative to the storage unit. The drive unit in particular moves the closing unit reversibly between the first pivot position and the second pivot position relative to the storage unit. The drive unit is provided in particular to arrange and/or fix the closing unit in at least one, in particular arbitrary, intermediate position relative to the storage unit. The intermediate position is in particular a position between the first pivot position and the second pivot position.

The configuration allows in particular efficient ventilation of the storage chamber to be achieved. In particular efficient storage of food, in particular in respect of long term preservation, can be achieved. In particular available space can be used optimally. The storage chamber can in particular be ventilated specifically, allowing in particular the preservation of food for a particularly long time. In particular it allows optimally tailored and/or dosed ventilation of the storage chamber. In particular a high quality rating can be achieved. For example an optical display can in particular allow simple monitoring of a position of the closing unit relative to the storage unit. In particular an opening width of the closing unit relative to the storage unit can be set in an at least substantially infinitely adjustable or continuous manner. Alternatively or additionally the opening width of the closing unit relative to the storage unit can be set in steps or discontinuously. For example there can be two or three settings for the opening width, so that a setting can be stepped over two steps or three steps. The three steps can be referred to for example as closed, half-open and fully open. The two steps can be differentiated for example as "closed" and "open". It is also possible to have four, five or six steps for a setting.

In a possible embodiment, the drive unit provides a lifting force acting on a side region of the closing unit for ventilation. At the start of the pivot movement of the closing unit relative to the storage unit the lifting force is aligned in particular at least substantially perpendicular to a main extension plane of the closing unit. A "main extension direction" of an object here refers in particular to a direction running parallel to a longest edge of a smallest notional geometric cuboid, which just encloses the object completely. In particular in the second storage state the drive unit raises the closing unit, in particular at least the side region of the closing unit, relative to the storage unit, and in particular pivots the closing unit about the pivot axis. In particular the pivot axis, in particular when viewing the closing unit and the storage unit from above at least in the first storage state, is arranged on a further side region of the closing unit opposite the side region. A "side region" of an object refers in particular to a region which, when the object is viewed from above, extends in proximity to a lateral boundary of the object. When the closing unit is viewed from above the side region is in particular at a distance of maximum 10 cm, in particular maximum 7 cm, advantageously maximum 5 cm and preferably maximum 3 cm from a lateral boundary of the closing unit. When the closing unit is viewed from above the side region is in particular at a distance of maximum 25%, in particular maximum 15%, advantageously maximum 10% and preferably maximum 5% of an extension of the closing unit, which is aligned in particular perpendicular to the lateral boundary of the closing unit, from a lateral boundary of the closing unit. An "extension" of an object refers in particular to a maximum distance between two points of a perpendicular projection of the object onto a plane. This in particular allows particularly advantageous ventilation properties to be achieved.

In a possible embodiment, the transmission unit of the drive unit provides the lifting force by means of the transmission unit. The transmission unit is provided in particular to change at least one movement quantity. The movement quantity could be for example a torque and/or a force and/or an acceleration and/or a velocity. This in particular allows reliable provision of the lifting force. For example the transmission unit could have a crank transmission and/or a wheel transmission and/or a roller transmission and/or a worm transmission. The transmission unit preferably has a cam transmission. In particular the drive unit provides a rotation movement for ventilation. In particular the drive unit brings about the lifting force, in particular the lifting force acting on the side region of the closing unit, by the rotation movement for ventilation. This means in particular that there is no need for a slotted guide.

In a possible embodiment, the transmission unit has at least one rotatable cam shaft with a cam portion and at least one guiding element driven by the rotatable cam shaft with the cam portion. In particular, the guiding element provides at least one guide path to guide the cam portion of the rotatable cam shaft for ventilation of the storage chamber. The cam shaft performs a rotation movement in particular for ventilation. The cam shaft has in particular an at least substantially L-shaped configuration, which is defined in particular by the cam shaft. In particular, the cam shaft is in particular configured as a single piece. "As a single piece" means in particular connected at least in a bonded manner, for example by a welding process, an adhesion process and/or a spraying process and/or advantageously shaped in a single piece, for example by being produced from one cast and/or by being produced using a single or multiple closing unit injection procedure and advantageously from a single workpiece. In particular, the cam shaft drives the guiding element. In particular the cam portion of the cam shaft moves along the guide surface provided by the guiding element. For ventilation the cam portion of the cam shaft, in particular the cam portion of the transmission unit, and the guiding element, in particular the guide surface provided by the guiding element, are arranged so that they are at least partially in contact with one another. This in particular allows particularly advantageous ventilation of the storage chamber. In particular, the cam portion may be integrally formed with the rotatably mounted drive shaft in a single piece in order to form the cam shaft. The drive unit preferably has at least one motor, which drives the rotatable cam shaft over the drive shaft. The "drive unit" refers in particular to a unit, which is provided to convert a form of energy, for example chemical energy and/or thermal energy and/or advantageously electrical energy, to kinetic energy. In particular, the motor unit provides a rotation energy for ventilation. The transmission unit provides the lifting force in particular by the rotation movement provided by the motor unit. In particular, the drive unit drives the cam portion over the cam shaft, in particular rotationally and advantageously by use of the rotation energy. In particular, the drive unit or motor unit is connected to the cam shaft in a rotationally fixed manner in the mounted state. The motor unit has in particular at least one electric motor. For example, the drive unit could have a dedicated control unit, in particular one that is separate from an appliance controller. Alternatively or additionally, the drive unit could be connected to an appliance controller. This in particular reduces the cost of the configuration. In particular, an opening width of the closing unit relative to the storage unit can be set in an at least substantially infinitely adjustable or continuous manner. Alternatively or additionally, the opening width of the closing unit relative to the storage unit can be set in steps or discontinuously. For example, there can be two or three settings for the opening width, so that a setting can be stepped over two steps or three steps. The three steps can be referred to for example as closed, half-open and fully open. The two steps can be differentiated for example as "closed" and "open". It is also possible to have four, five or six steps for a setting.

In a possible embodiment, the guiding element is connected to the closing unit in at least one mounted state. In the mounted state the guiding element could be connected to the closing unit for example in a bonded manner, in particular as a single piece and/or by an adhesive connection. In the mounted state the guiding element is advantageously connected to the closing unit with a force fit and/or with a form fit. In particular, the guiding element is connected to the closing unit in such a manner that it cannot be moved relative to the closing unit in the mounted state. For example, the guiding element could be connected to the closing unit by a screw connection and/or by a rivet connection and/or by a connection brought about by locking in the mounted state. The guiding element is advantageously connected to the closing unit by a latching connection in the mounted state, allowing in particular a high level of flexibility. Connecting the guiding element to the closing unit in particular allows a high level of stability to be achieved.

It is a possible embodiment that the guiding element has at least one helical path, which in particular at least substantially defines the guide path and along which the cam portion of the cam shaft in particular moves. In particular, the guiding element has an engagement cutout, in which the cam portion in particular engages and around which the helical path is arranged. This allows in particular a particularly effective and/or space-saving configuration.

It is a possible embodiment, the base plate has at least one retaining element, which at least substantially prevents movement of the closing unit at least in the horizontal direction or at least during movement of the storage unit in a horizontal direction, in particular when the storage unit is pulled out of a refrigeration chamber in the horizontal direction. For example, the retaining element could be arranged on a front area of the base plate on a bottom wall of the base plate and in particular be connected at least partially to the closing unit and in particular at least substantially prevent movement of the closing unit in the horizontal direction by a retaining force counter to the movement of the closing unit. In the installed state of the base plate, the front area of the base plate is closer to the access opening of the receiving space than the rear area of the base plate. The retaining element advantageously provides a stop for the closing unit and at least substantially prevents movement of the closing unit at least in the horizontal direction in particular by the stop. In an installed position the horizontal direction is in particular aligned at least substantially parallel to the base. This is particularly user-friendly and/or saves the operator work in particular in the form of raising the closing unit relative to the storage unit.

It is a possible embodiment that the retaining element defines at least partially the pivot axis. The retaining element supports the closing unit in particular in a pivotable manner relative to the storage unit. In particular the closing unit has at least one coupling element. In particular the coupling element is connected to the retaining element in the mounted state and in particular retained by the retaining element and/or supported in a pivotable manner by the retaining element. The coupling element in particular at least partially defines the pivot axis. This means that there is no need in particular for further parts, which could be provided to define the pivot axis, thereby allowing costs in particular to be kept low.

In a possible embodiment, the closing unit is at least partially light permeable for passing light emitted from the light module into the storage chamber, in particular is the closing unit formed as a light guide plate for surface illumination of the storage chamber. The closing unit may be a lid movable relative to storage unit and may be configured to diffuse or scatter the light emitted by the light module. The light of the light module is coupled into the storage unit through the closing unit, preferably a lid, so that the light is not directed to the front side of the household cooling appliance but always into the storage chamber even if the storage unit, preferably storage bowl, is in the pulled out state.

In a possible embodiment, the light module is arranged on a module carrier of the separation unit. This module carrier is preferably separate from the light module. The module carrier is arranged to be sunk in, in particular completely sunk in, in the clearance of the base plate. Thereby a separate element is created, which is provided for receiving the complete light module. The light module is therefore also protected by the thermally insulating material arranged in the clearance. Moreover, by this module carrier also a precisely positioned and mechanically stable installation of the light module on the base plate, in particular also in the clearance, is facilitated. Not least the module carrier in an embodiment may also serve for being able to receive and guide for instance also cables, which are laid to the light module.

In a possible embodiment, the light module contains a light housing having a diffusor. The diffusor is preferably integrally formed with the light housing. Moreover, the light module may comprise a circuit board with at least one light source. The light housing may be pot-shaped and the circuit board may be received in a pot-shaped receiving cavity of the light housing. The light source may for instance be a light-emitting diode. The circuit board may be received and positioned by snap-fit elements inside the U-shaped cavity of the light housing. At the interior wall surface of the module carrier is provided a fixing structure, e.g. either hook or lug, which engages with a counter fixing structure, e.g. either hook or lug, provided on the outer wall surface of the light housing protruding into the cavity of the module carrier. Thus, a more homogeneous illumination of the subspace in the receiving space which is to be illuminated by the light module is effected.

In a possible embodiment, the base plate contains a bottom wall made of metal. Thereby it is rendered stable. Moreover, it then may also serve as reflector at least in part. Light emitted by the light module from the base plate towards the bottom and, if applicable, is reflected via other elements and portions back to the bottom wall, may then again be reflected by such a metallic bottom wall into the subspace of the receiving space, which is illuminated by the light module. In particular if the bottom wall is made of a polished metal, this is advantageous. The bottom wall may for instance be made of stainless steel.

In a possible embodiment, the thermally insulating material is expanded polystyrene. This material, which is also referred to as Styrofoam, is very lightweight and still has a strong thermally insulating effect. Moreover, this material also in the uninstalled state is present as element that is stable in terms of shape and dimension. It may therefore be designed, in particular cut, very precisely in terms of shape. Therefore, the clearance in this regard may also be as comprehensively as possible filled with this material. This material is also particularly advantageous with regard to the fact that recesses that are precise in shape and permanently present may be created in this material. Thus it is possible that for instance also cable ducts or conduits or the like may be created in this material, into which then these closing units are also received. In particular the thermally insulating material may be a polystyrene board.

In a possible embodiment, the electronics module is a detection sensor for detecting a storage parameter of the receiving space, wherein the detection sensor is sunk in in a recess of a bottom wall of the base plate for detecting a storage parameter in a lower volume subspace of the receiving space. The detection sensor may be a temperature sensor for detecting the temperature of the storage chamber or a humidity sensor for detecting the humidity of the storage chamber or the detection sensor may be both. The detection sensor may be provided in a sensor housing received in the recess, and the sensor housing may have openings or slits, so that air from the storage chamber can flow into the sensor housing and becomes in contact with the detection sensor. In this way, the position of the closing unit relative to the storage unit or ventilation of the storage chamber is adjustable depending on the temperature and/or humidity in the storage chamber.

In a possible embodiment, on a vertical sidewall of the base plate bearing elements are arranged for bearing the separation unit in the receiving space. This sidewall is a narrow side of the base plate. Bearing elements are provided in particular for mechanical coupling. Thereby, a particularly simple removing and inserting of the separation unit in the receiving space is facilitated.

In particular the base plate, viewed in the width direction, of the household cooling appliance, across the entire inner width between two opposite vertical sidewalls of an inner liner, which bound the receiving space. Thereby, viewed in height direction, a complete separation of the receiving space in a top and a bottom volume subspace is facilitated by this separation unit. In particular the separation unit, preferably the base plate, is releasably mounted on sidewalls, which are opposite in width direction, with corresponding bearing elements.

In a possible embodiment, the bearing elements are parts that are separate from a bottom wall and/or a ceiling wall of the base plate. In particular these bearing elements are attached to a bottom side of a ceiling wall. They may be fastened thereto by an adhesive bond, for instance a double-sided adhesive tape.

In a possible embodiment, the bearing elements are lateral boundings of the clearance. In particular by these bearing elements also the thermally insulating material arranged in the clearance is laterally covered by these bearing elements.

In a possible embodiment, the bottom wall of the base plate is configured as U-shaped component. This means that on opposite end portions in the width direction it comprises wall parts oriented towards the top. In particular here it is envisaged that the above-named bearing elements are directly arranged on these partial elements of the bottom wall, which extend towards the top, and here are mechanically coupled thereto. Thus, in an embodiment the bottom wall is indirectly coupled via these bearing elements to the ceiling wall of the base plate.

In a possible embodiment, the module carrier mentioned above, which is provided for receiving the light module, is arranged directly on an inner side of the bottom wall of the base plate. It may be fastened directly there. For instance, it may be fastened by an adhesive bond thereto. Particularly advantageous in this connection is a double-sided adhesive tape.

The light module is preferably fastened only to this module carrier. It is preferably arranged without contacting the bottom wall of the base plate.

In a possible embodiment, an outer side of the light module, in particular a bottom side of the light module, is arranged flush with a surface of the base wall, in particular a bottom wall of the base plate.

In a possible embodiment, the module carrier is only connected with this above-mentioned adhesive bond to the bottom wall. Additional fastening elements, such as for instance screws or snap-fit elements or the like, are not provided. Thus, a particularly simple mounting concept is facilitated. Moreover, the elements, viewed per se, namely the module carrier and the bottom wall, may be of a simpler design, since also no snap-fit hooks or the like need to be integrally formed therewith. Moreover, an adhesive bond is simpler and sturdier and for instance a breaking or bending of snap-fit elements or the like can be avoided.

In a possible embodiment, it is possible to provide that the light module and the module carrier are latched to one another via fixing structures that are formed on the light module and the carrier module, wherein the fixing structures are formed in such a manner that they can lock or can latch to and be detached from one another owing to a relative movement of the light module and the carrier module. This means that the fixing structures can be latched by displacing the light housing in the receiving cavity of the carrier module, for example by displacing the light housing in perpendicular direction of the opening of the carrier module. By displacing the light module in the receiving cavity of the module carrier along the longitudinal direction in the opposite direction, it is possible to bring the latching structures out of engagement again.

In a possible embodiment it is possible to provide that latching structures of the light module are formed as projections that can deform in an elastic manner, wherein catching structures of the module carrier are formed as depressions and the projections protrude into the depressions and the depressions have an incline on at least one side in relation to the longitudinal direction along which the projections slide. The depression can have for example opposite lying edges and a base, wherein the incline extends between the base and one of the edges. In the latched state of the light module and carrier module, in each case a projection protrudes into in each case a depression. In order to unlatch the light module and carrier module, it is possible to move the light in the direction of the opening or in the direction of the incline of the depression. As a consequence, the projection slides on the incline of the depression of the module carrier and is deformed in an elastic manner by the incline or the acting reaction force, with the result that the projection can be moved out of the depression. This facilitates both the installing as well as the dismantling.

In a possible embodiment, it is possible to provide that the latching structures of the light module are configured as a single part with the light housing. The light housing can be formed for example from a plastic material. The latching structures can be produced for example together with the light housing with integrated diffusor in a plastic injection molding method.

In a possible embodiment, it is possible to provide that the catching structures of the module carrier are formed on an inner side surface of the receiving cavity of the carrier module. The side walls can extend in particular in a transverse manner with respect to a module carrier base and delimit the light opening in relation to a width direction that extends in a transverse manner with respect to the longitudinal direction. In particular, the side walls can also extend between module carrier end walls of the module carrier, which lie opposite one another in relation to the longitudinal direction.

In a possible embodiment, it is possible to provide that the module carrier has a circumferential frame that surrounds the opening and protrudes into the opening. The frame can be formed in particular by an end region of the side walls and of the end wall and the end region is placed remote from a module carrier base of the module carrier, and also in the first end region of the module carrier by a connecting piece. The frame surrounds the diffusor of the light housing and is consequently placed between the diffusor and a circumferential edge of the opening. The frame consequently advantageously covers the circumferential edge of the opening. The opening and the light housing can consequently be produced with larger tolerances. Moreover, it is possible to omit a coating or other processing so as to improve the optical impression of the circumferential edge of the opening.

In a possible embodiment, it is possible to provide that the frame ends flush with respect to an inner surface of the bottom wall or protrudes somewhat beyond the inner surface, for example by a length of less than or identical to 0.5 mm in which the opening is formed. Consequently, an essentially flush arrangement of the light in the opening is achieved.

In a possible embodiment, it is possible to provide that the illuminating facility has a carrier on which the illuminating elements are arranged spaced apart with respect to one another and are contacted, wherein the electrical connection is arranged on an end of the carrier, and wherein the carrier extends in the receiving cavity of the module carrier along the longitudinal direction. The illuminating elements can be for example LEDs. The carrier can be for example a board or circuit board.

In a possible embodiment, it is possible to provide that the diffusor of the light housing is formed as a plate that extends in the light opening of the module carrier along the longitudinal direction, wherein the light housing has side parts that lie opposite one another and that extend in a transverse manner with respect to the diffusor and the circuit board with the light sources is fastened to the side parts by snap-fit connections. The diffusor can be formed for example from a material that is in part transparent for visible light, in particular from a plastic material. The diffusor can be formed from a material that is semitransparent for light, in particular from a plastic material. In general, the diffusor is configured so as to scatter visible light. The diffusor can be arranged lying opposite the light sources in order to scatter the light that is emitted from the light sources. The scattering of the light can be caused for example by corresponding roughening of the surface of the diffusor or particles that are embedded in the diffusor.

The electrical connection may be provided as a plug which is connected to a counter plug before the light is inserted into the receiving cavity of the module carrier. Further, the electrical connection may be provided by plug connection after the light is inserted into the receiving cavity of the module carrier. In a further embodiment, the electrical connection may be provided by electrical contact pins mounted on the light connected to electrical contact surfaces mounted on the module carrier, or vice versa, after the light is inserted into the receiving cavity of the module carrier. In this way, the manufacturing process is provided more efficient and simplified.

By the indications "top", "bottom", "front", "back", "horizontal", "vertical", "depth direction", "width direction", "height direction" the positions and orientations given in case of use and positioning of the appliance according to the intended purpose are indicated.

Further features of the invention derive from the claims, the figures, and the description of the figures. The features and feature combinations previously named in the description, as well as the features and feature combinations named in the following in the description of the figures and/or shown in the figures alone can be used not only in the respectively indicated combination, but also in other combinations or alone, without leaving the scope of the invention. Thus, also implementations of the invention are to be considered as comprised and disclosed, which are not explicitly shown and explained in the figures, however derive from separated feature combinations from the explained implementations and can be generated from them. Also explanations and feature combinations are to be regarded as disclosed, which thus do not comprise all features of an originally formulated independent claim.

Other features which are considered as characteristic for the invention are set forth in the appended claims.

Although the invention is illustrated and described herein as embodied in a household cooling appliance with a plate-like separation unit, which is configured as multi-module carrier plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

In the figures the same elements or elements having the same function are equipped with the same reference signs.

DETAILED DESCRIPTION OF THE INVENTION

Figure 1:
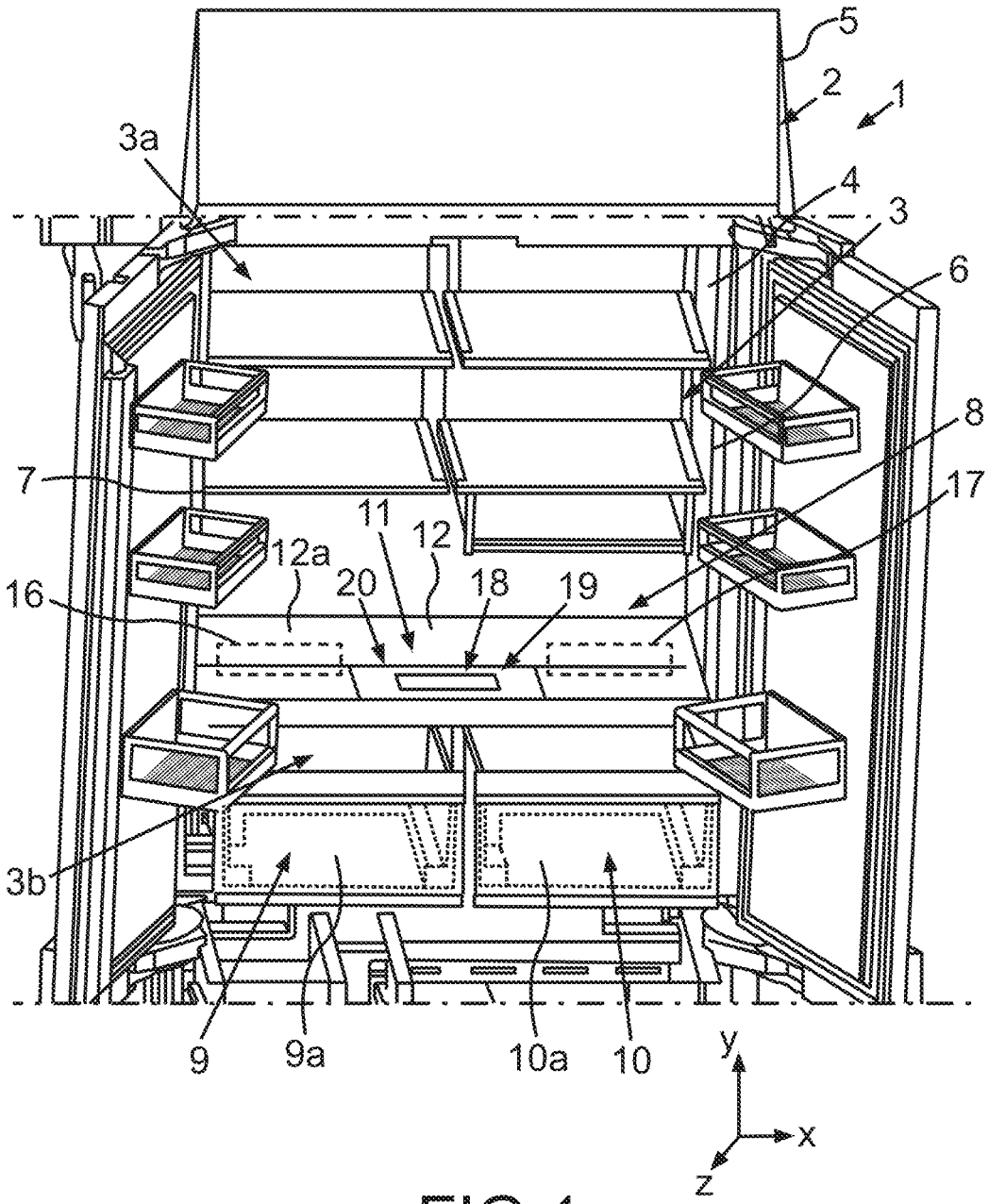
FIG. 1 is a diagrammatic, perspective partial view of an embodiment of a household cooling appliance according to the invention.

Referring now to the figures of the drawings in detail and first, particularly to FIG. 1 thereof, there is shown a perspective front view an embodiment of a household cooling appliance 1. This is represented in a sub-portion. The household cooling appliance 1 may be a cooling appliance or a freezer or a fridge-freezer combination device. The household cooling appliance 1 contains a housing 2. In the housing 2 at least one receiving space 3 for food is configured. The receiving space 3 is here a cooling compartment. The household cooling appliance 1 contains an inner liner 4. The inner liner 4 is received in an outer housing 5 of the housing 2. The inner liner 4 bounds the receiving space 3 by walls. In this regard, at least one first vertical sidewall 6 and one opposite second vertical sidewall 7 is provided. In FIG. 1, z-direction corresponds to a depth direction (z).

Moreover, the household cooling appliance 1 contains a plate-like separation unit 8. This is non-destructively releasably arranged in the receiving space 3. It is arranged for separation of the volume of the receiving space 3. In the shown embodiment by this separation unit 8 an upper volume subspace 3*a* and a lower volume subspace 3*b* are formed. As can be seen, the separation unit 8 extends in the width direction (x) of the household cooling appliance 1 across the entire width between the vertical side walls 6 and 7.

Figure 2:
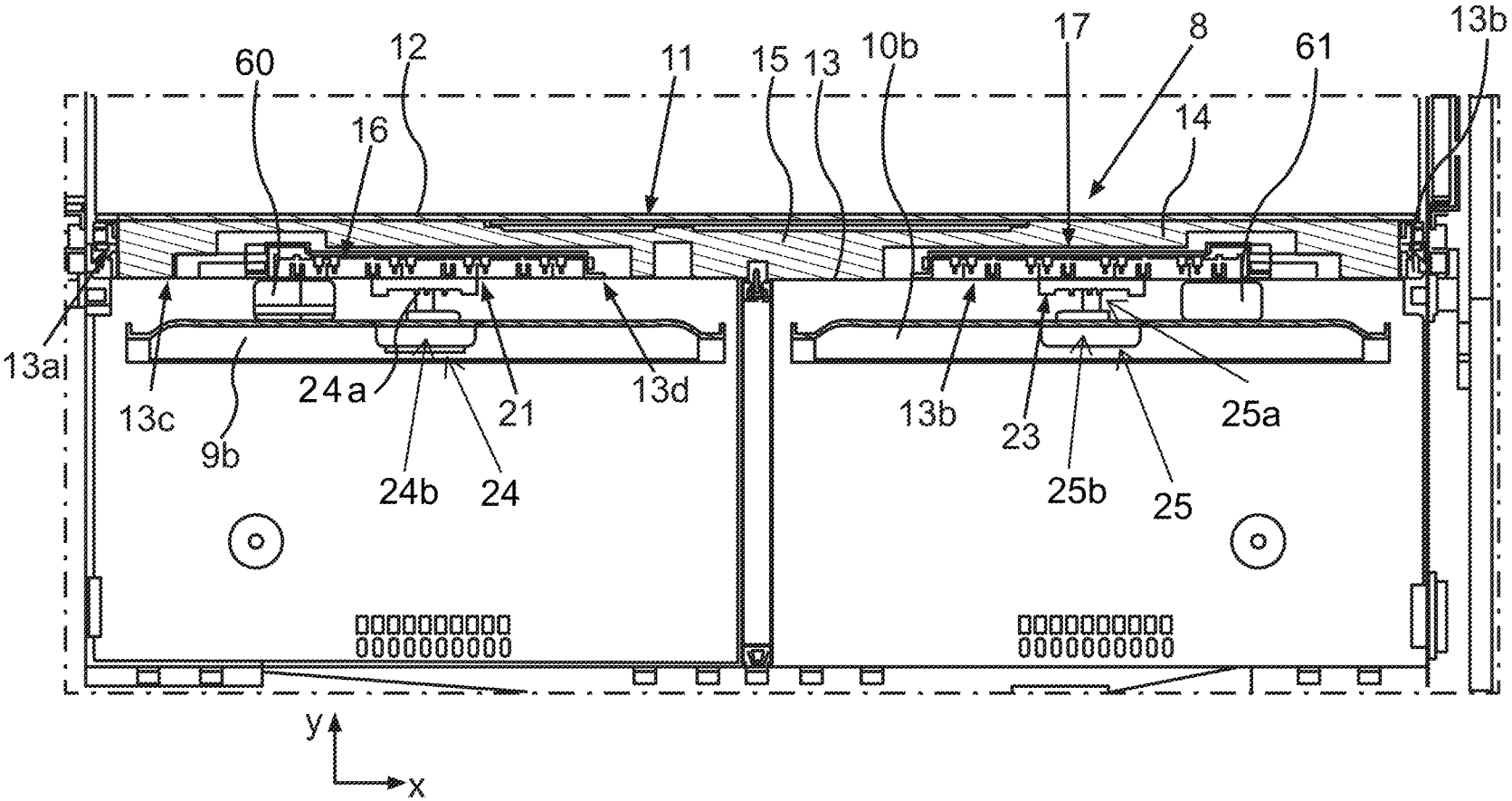
FIG. 2 is a vertical sectional view through a sub-portion of the household cooling appliance according to FIG. 1.

As may be moreover be discerned, in an embodiment in the lower volume subspace 3*b* storage chambers 9 and 10 are arranged for storing food. These storage chambers 9 and 10 may in particular be keep-fresh containers. This means that they each comprise a first storage unit 9*a* and a second storage unit 10*a* or storage bowls as well as separate first closing unit 9*b* and second closing unit 10*b* or lids (FIG. 2). Thus, also closed storage volumes may be provided by these storage chambers 9 and 10.

The plate-like separation unit 8 in an embodiment contains a base plate 11. The base plate 11 contains a ceiling wall 12. Same may in particular be a glass plate. Moreover, the base plate 11 contains a bottom wall 13. Same is separate from the ceiling wall 12. The bottom wall 13 may also be configured to be integrally formed. It may in particular be made of metal. Preferably the bottom wall 13, viewed in the width direction, on opposite ends comprises upwardly oriented fillets 13*a* and 13*b* or stripes (FIG. 2). These are examples of wall parts that extend towards the top. In particular therefore this bottom wall 13 in a sectional plane, which is spanned by height direction (y) and the width direction of the household cooling appliance 1, has a U-shape.

The base plate 11 is a thermal insulation plate. Into a clearance 14, which is formed between the ceiling wall 12 and the bottom wall 13, a thermally insulating material 15, which is separate therefrom, is inserted. Same is in particular expanded polystyrene. In particular this thermally insulating material 15 may be a polystyrene board.

This base plate 11 is configured as multi-module carrier plate for receiving several separate and functionally different electronic modules 18. The base plate 11 in the embodiment comprises at least one light module. This is in particular the case because the two separate storage chambers 9 and 10, which here are to be taken merely in an exemplary way, are thereby capable of being illuminated individually from the top.

Moreover, on the base plate 11 a functionally different further electronics module 18 that is separate from at least one light module 16, 17 is arranged. In the embodiment, this electronics module 18 is in particular an operating and/or display device 19.

As may be discerned already in the representations in FIG. 1 and FIG. 2, this operating and/or display device 19 is arranged to be sunk at least in part, in particular completely, in the base plate 11. Preferably, the ceiling wall 12 contains a second opening 20. This operating and/or display device 19 in the mounted end state is arranged to be uncovered towards the top through this second opening 20. Thereby an operating portion and/or a display portion may be viewed without restrictions and is correspondingly accessible.

In an embodiment, it may be envisaged that a surface of the operating and/or display device 19 is arranged to be flush with a top side 12*a* of the ceiling wall 12.

The here preferably first light module 16 and second light module 17 are in particular, as this may be seen in the sectional view in FIG. 2, arranged to be sunk at least in part, or completely, in the base plate 11 in particular in a respective recess. As may be discerned and is characterized by the merely dashed representation in FIG. 1, these light modules 16 and 17 are arranged to be covered towards the top. They therefore can be neither viewed from the top via the base plate 11, nor can they emit light towards the top in the embodiment.

Rather, it is envisaged in the embodiment that the light modules 16 and 17 are installed in such a way that they can emit light only towards the bottom. For this purpose, it is envisaged that the bottom wall 13 comprises first openings 13*d*. Recesses in the clearance 14, in particular in the polystyrene board, are provided to be able to receive the light modules 16 and 17 therein. In particular, here, too, it is envisaged that the light modules 16 and 17 are arranged with their surface that is externally uncovered, in particular the bottom side, to be flush with a third bottom side 13*c* of the bottom wall 13.

Also for this operating portion and/or a display portion, in other words operating and/or display device 19 in the clearance 14 space is cut out, in particular in the polystyrene board a recess is configured.

In an embodiment on the base plate 11 in addition to the light modules 16, 17 and the operating portion and/or a display portion is arranged at least one further electronics module 18. In the embodiment, this is a drive unit 60, 61, in particular a first drive unit 60 and second drive unit 61. Same is here according to the intended purpose provided for driving a first closing unit 9*b* and a second closing unit 10*b* of the household cooling appliance 1 that is external to the separation unit 8. In particular, this drive units 60, 61 are provided for driving the closing units 9*b*, 10*b* over transmission units 24, 25. For this purpose, the first transmission unit 24 and second transmission unit 25 are rotatably coupled to the drive units 60, 61, which are only schematically shown. The first transmission unit 24 contains a first cam shaft 24*a* having a first cam portion and the second transmission unit 25 contains a second cam shaft 25*a* having a second cam portion. The cam shafts 24*a*, 25*a* may have an L-shaped configuration and are rotatable coupled with the drive unit 60, 61 by a drive shaft. The rotatable first cam shaft 24*a* is coupled to a first guiding element 24*b* of the first closing unit 9*b* and the second rotatable cam shaft 25*a* is coupled to a second guiding element 25*b* of the second closing unit 10*b*. The guiding element 24*b*, 25*b* provides at least one guide path to guide the cam portion of the cam shaft 24*a*, 25*a* for ventilation of the storage chamber. For example, the guiding element 24*b*, 25*b* may be provided with an engagement cut-out shaped like a helical path. In particular, the engagement cut-out with the helical shape defines the guide path along which the cam portion of the first or second rotatable cam shaft 25*a*, 25*a* moves when the respective drive unit 60, 61 rotates the first cam shaft 24*a* or second cam shaft 25*a*. In this way, the closing units 9*b*, 10*b* may be moved in vertical direction by the drive units 60, 61, in particular raised or let down, so that the height position of the closing units 9*b*, 10*b* relative to the storage units 9*a*, 10*a* is changed for different ventilation of the storage chambers 9, 10. The respective drive units 60, 61 are preferably arranged on a rear bottom side of the base plate 11, especially in the rear third of the base plate 11.

Figure 3:
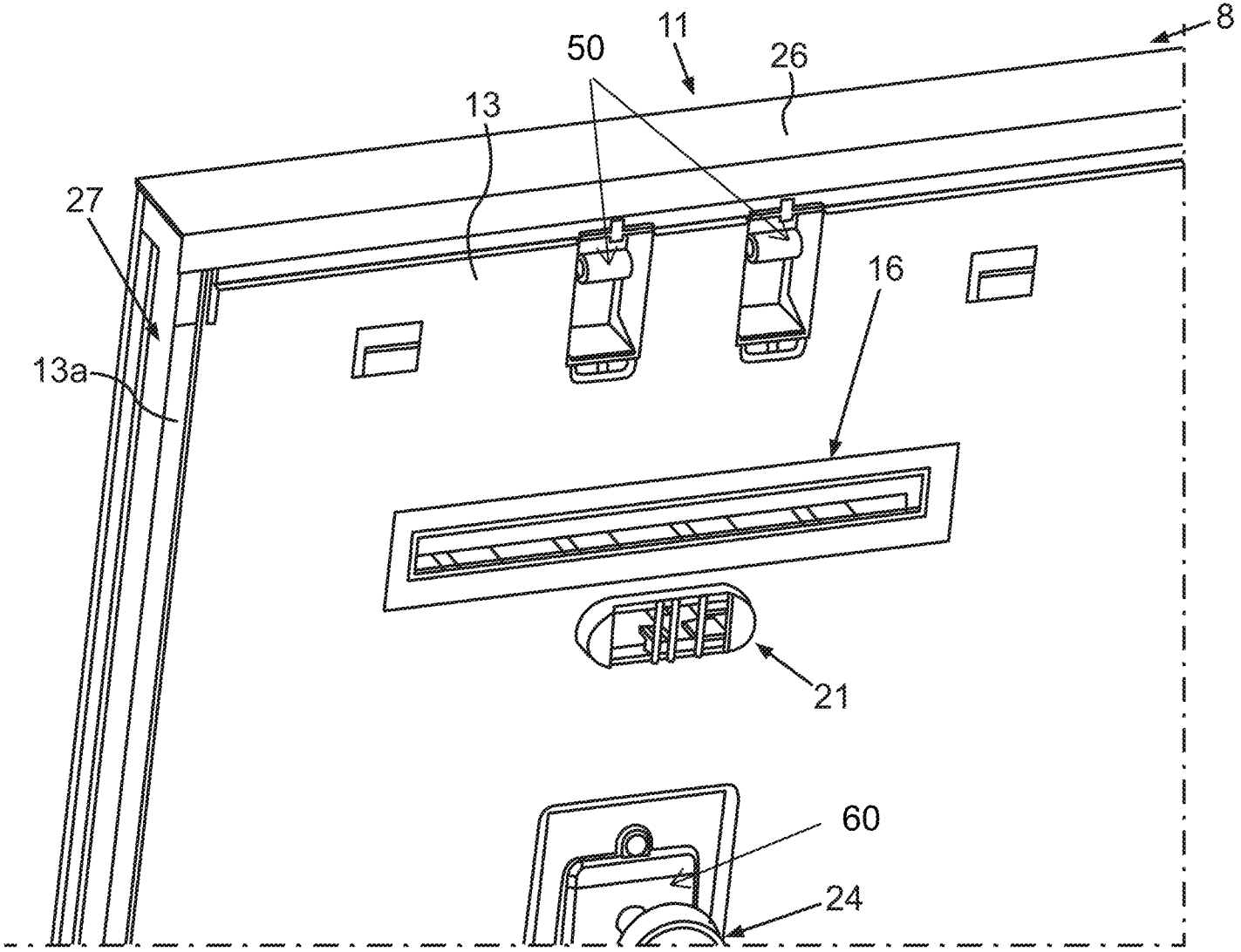
FIG. 3 is a perspective partial view of an embodiment of a plate-like separation unit of the household cooling appliance.

In FIG. 3 in perspective partial view an embodiment of the separation unit 8 is shown. Here a view from below is shown. Therefore, the bottom wall 13 is shown. The light module 16 is represented. Also, the first drive unit 60 with partial closing units is represented in FIG. 3. The first transmission unit 24 is equally shown in part. As may be also discerned in FIG. 3, the base plate 11 comprises a front panel 26. Same, too, is configured as separate closing unit. It covers the bottom wall 13 and the ceiling wall 12 on the front side. As may moreover be discerned, the base plate 11 on its side walls comprises bearing elements 27. These bearing elements 27 according to the intended purpose are configured for bearing the separation unit 8 on the first vertical sidewall 6 and second vertical sidewall 7. Further is installed a first detection sensor 21, e.g. temperature sensor for detecting the temperature or a humidity sensor for detecting the humidity in the area of the first storage chamber 9. The first detection sensor 21 is installed between the first drive unit 60 provided at the rear and light module 11 provided on the front bottom side of the separation unit 8. The first detection sensor 21 may be provided in a sensor housing with slots for air exchange with the area of the first storage chamber 9 and the sensor housing is positioned in the clearance 14 of the base plate 11 exposed to the bottom.

Further, the base plate 11 has a first retaining element 50, which at least substantially prevents movement of the closing unit at least in the horizontal direction at least during movement of the storage unit in a horizontal direction, in particular when the storage unit is pulled out of a refrigeration chamber in the horizontal direction. The first retaining element 50 is arranged on a front area of the base plate on a bottom wall of the base plate 11. The first retaining element 50 defines at least partially the pivot axis of the second closing unit 10*b*. The first retaining element 50 supports the second closing unit 10*b* in particular in a pivotable manner relative to the storage unit.

Figure 4:
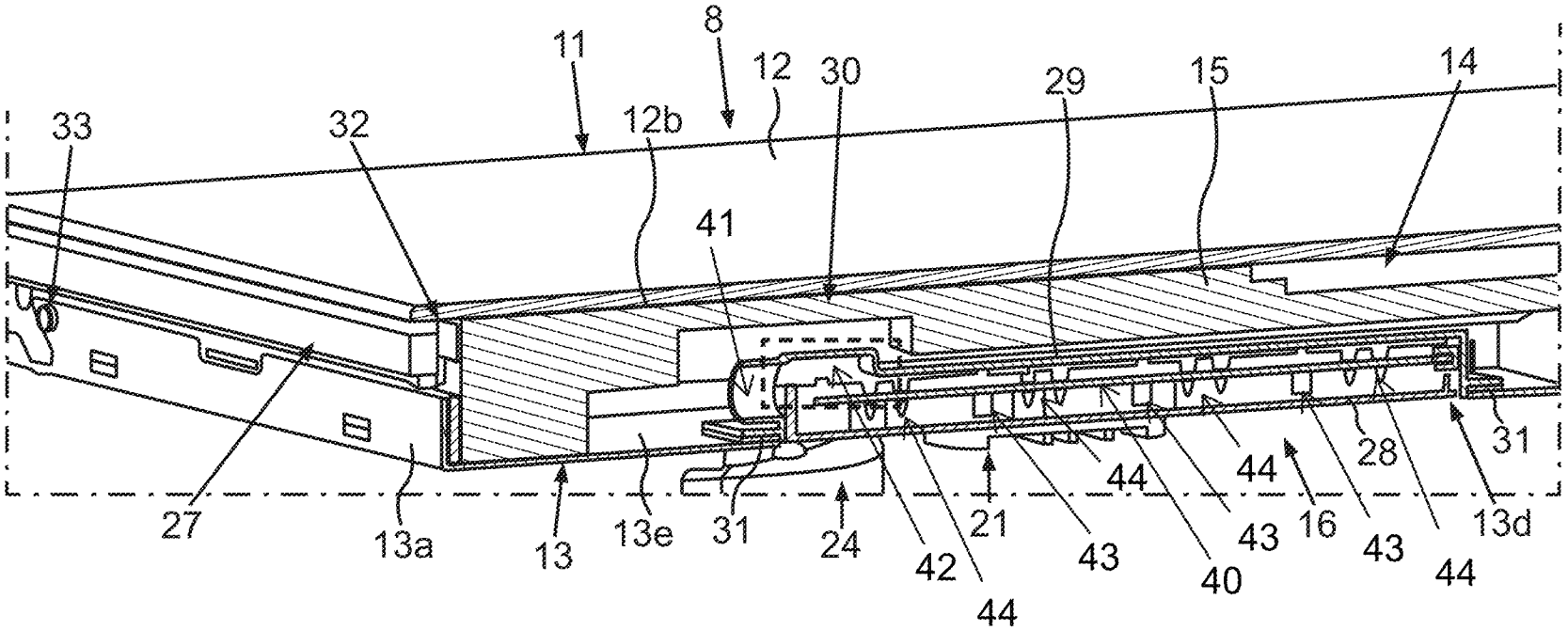
FIG. 4 is a perspective sectional view through the separation unit according to FIG. 3.

In FIG. 4 a perspective sectional view of the separation unit 8 is represented. As is shown in this sectional view, the first light module 16 contains a light housing 28. Moreover, the first light module 16 contains a circuit board, which is not shown here and which comprises at least one light source 43, especially a light emitting diode. The circuit board 40 is received and positioned by snap-fit elements inside an inner cavity of the light housing 28. At the interior wall surface of the first module carrier 29 is provided a fixing structure 44, e.g. either hook or lug, that engages with a counter fixing structure (not shown), e.g. either hook or lug as well, provided on the outer wall surface of the diffusor 28 protruding into the cavity of the first module carrier 29. In particular it is envisaged that the base plate 11 contains a first module carrier 29. Same is separate from the light module 16. The first module carrier 29 is arranged in the clearance 14, in particular in a corresponding recess of the thermally insulating material. The first module carrier 29 receives the light module 16. The first module carrier 29 is arranged by an adhesive bond, in particular only by first adhesive bonds 31, on an inner side 13*e* of the bottom wall 13. The first module carrier 29 has an electrical connection cavity 42 for connecting of the circuit board 40 to an electrical connector of electrical cables (not shown). At the area of the electrical connection cavity 42 the height of the recess is greater than the majority of the recess for the first module carrier 29. As may be moreover also be discerned in FIG. 4, the bearing elements 27 are arranged directly on the second bottom side 12*b* of the ceiling wall 12. In particular, they are in this regard fastened thereto by a second adhesive bond 32. Moreover, in FIG. 4 it may also be discerned that the bottom wall 13, in particular with its first fillet 13*a* and second fillet 13*b* that are extending towards the top, is directly connected to the bearing elements 27. In particular here at least one screw connection 33 may be provided.

A second module carrier 30 for the second storage chamber may be provided accordingly.

Figure 5:
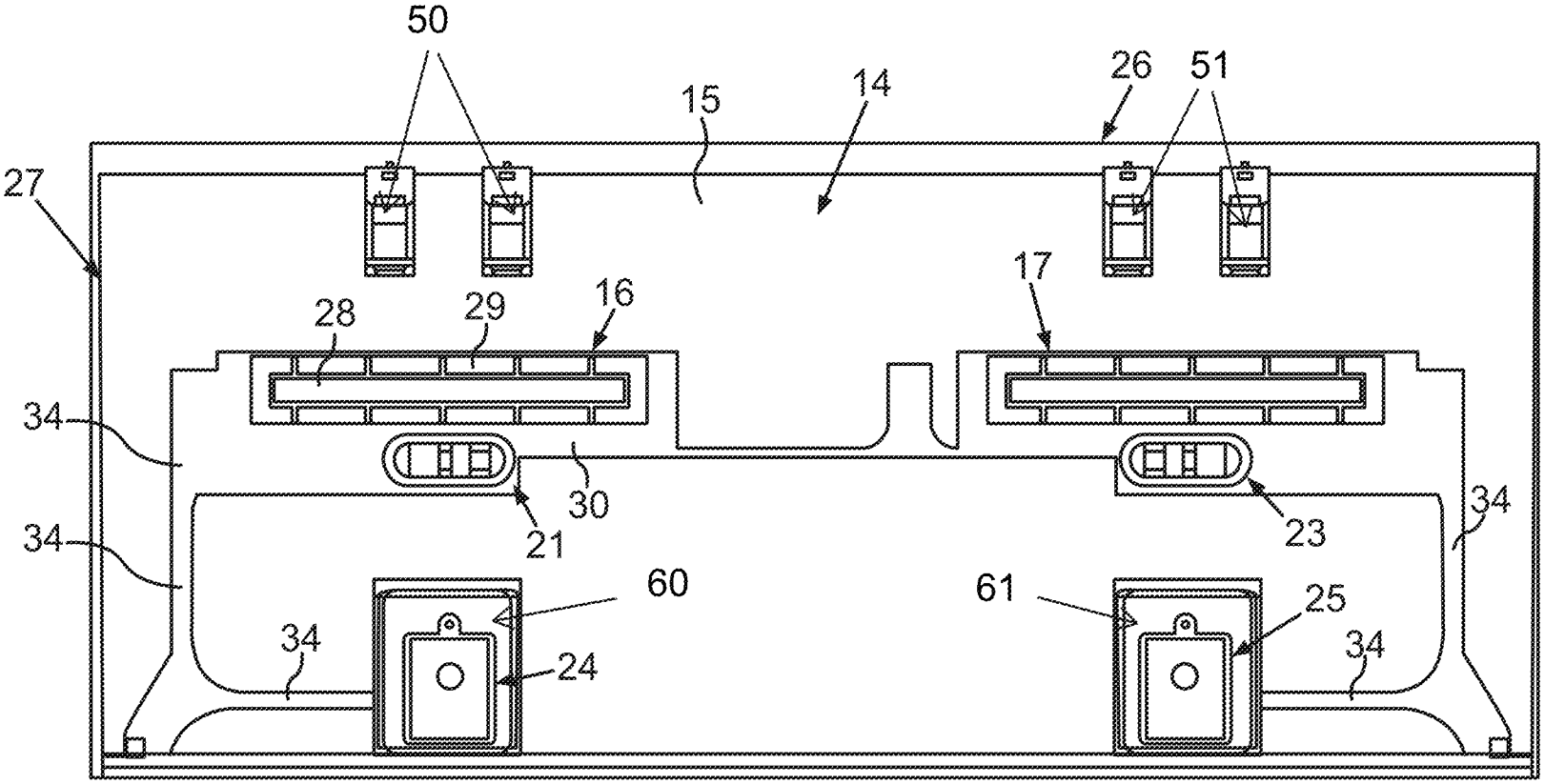
FIG. 5 is a view from below of the separation unit according to FIG. 3 and FIG. 4 with a removed bottom wall.

In FIG. 5 the separation unit 8 is shown in a view from below, wherein here the bottom plate 13 is detached. Therefore a view of the clearance 14 and in particular the uncovered thermally insulating material 15 is represented. In this connection then also further recesses or cut-outs 34, respectively, are shown. These may for instance also be cable ducts or conduits or the like. The first cut-out is provided for guiding of the cables from rear part of the separation unit 8 to the first detection sensor 21, first drive unit 60 and first light module 16, and the second cut-out is provided for guiding of the cables from the rear side of the separation unit 8 to the second detection sensor 23, the second drive unit 61 and second light module 17. Further, at the front area of the separation unit 8 is provided the first retaining element 50 supporting the first closing unit 9*b* and a second retaining element 51 supporting the second closing unit 10*b*.

Figure 6:
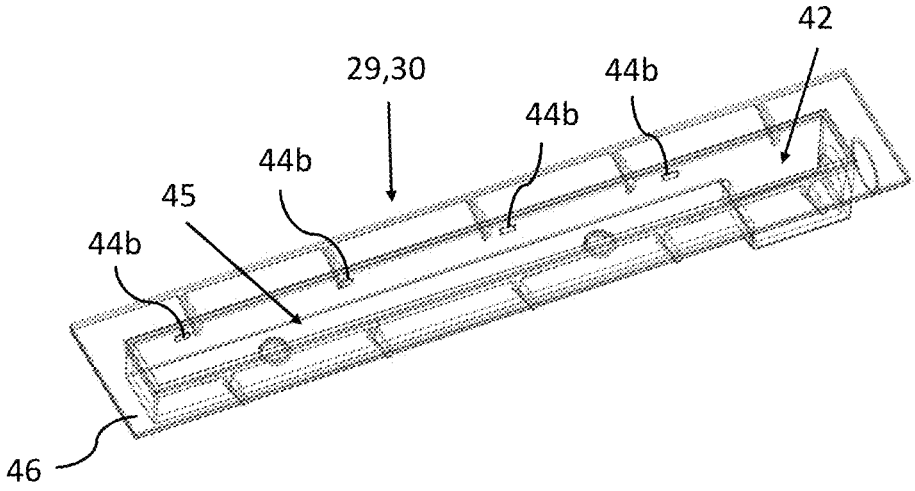
FIG. 6 is a perspective view of an embodiment of the module carrier according to FIG. 4

FIG. 6 shows a perspective view of an embodiment of the module carrier 29, 30 according to FIG. 4. The module carrier 29, 30 comprises catching structures 44*b* on an inner side surface of a receiving cavity 45 of the module carrier 29, 30. The catching structures 44*b* of the module carrier 29, 30 are formed as depressions and the projections of the latching structure 44*a* protrude into the depressions and the depressions have an incline on at least one side in relation to the longitudinal direction along which the projections slide. The depression can have for example opposite lying edges and a base, wherein the incline extends between the base and one of the edges. In the mounted state of the light module 16, 17 in the receiving cavity 45 of the module carrier 29, 30, the catching structures 44*b* engaging with the latching structures 44*a* of the light module 16, 17. At the end portion of the receiving cavity 45 is arranged an electrical connection cavity 42 for receiving a plug of the light module 16, 17. The electrical connection cavity 42 is formed deeper than the majority of the receiving cavity 45. Further, a flange surface 46 surrounds the receiving cavity 45 of the module carrier 29, 30 on which can be arranged a first adhesive bond 31 for attaching the module carrier 29, 30 to an inner side 13*e* of the bottom wall 13 of the base plate 11.

Figure 7:
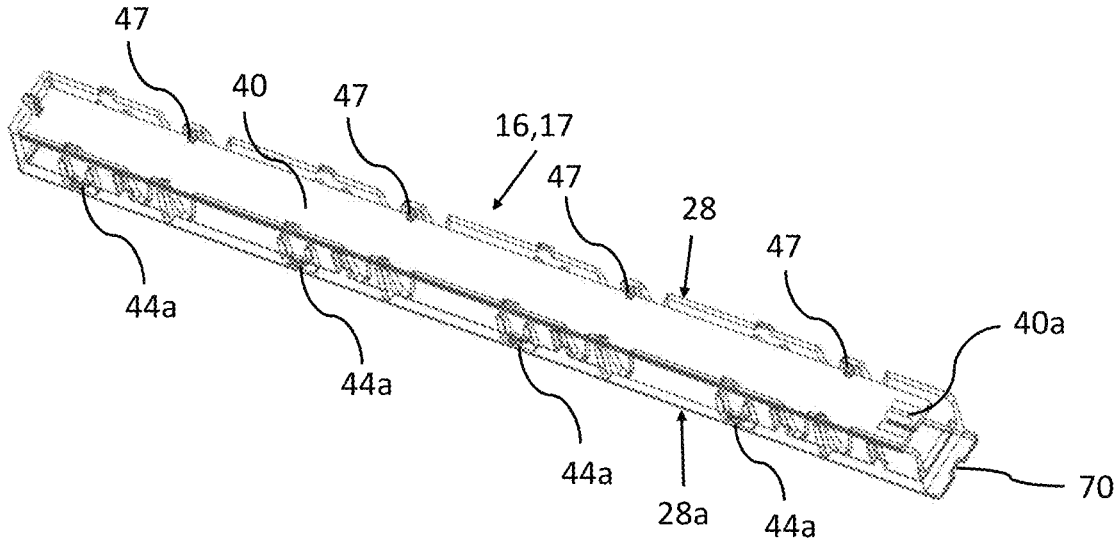
FIG. 7 is a perspective view of an embodiment of the light module according to FIG. 4.

FIG. 7 shows a perspective view of an embodiment of the light module 16, 17 according to FIG. 4. The light module 16, 17 contains a light housing 28 having latching structures 44*a* on the outer side surface of the light housing 28. The light housing 28 further having snap-fit connection protruding into cavity of the light housing 28 for retaining the circuit board 40. At an end portion the circuit having electrical connections 40*a* for attaching an edge connector (not shown). There is also an electrical connection opening 41. The light housing 28 comprises a bottom wall formed as diffusor 28*a* through which emits the light of the light sources on the circuit board 40. The light module 16, 17 has an extension with a hole 70 for removing the light module 16, 17 from the receiving cavity 45 of the module carrier 29, 30 in an easy manner.

Figure 8:
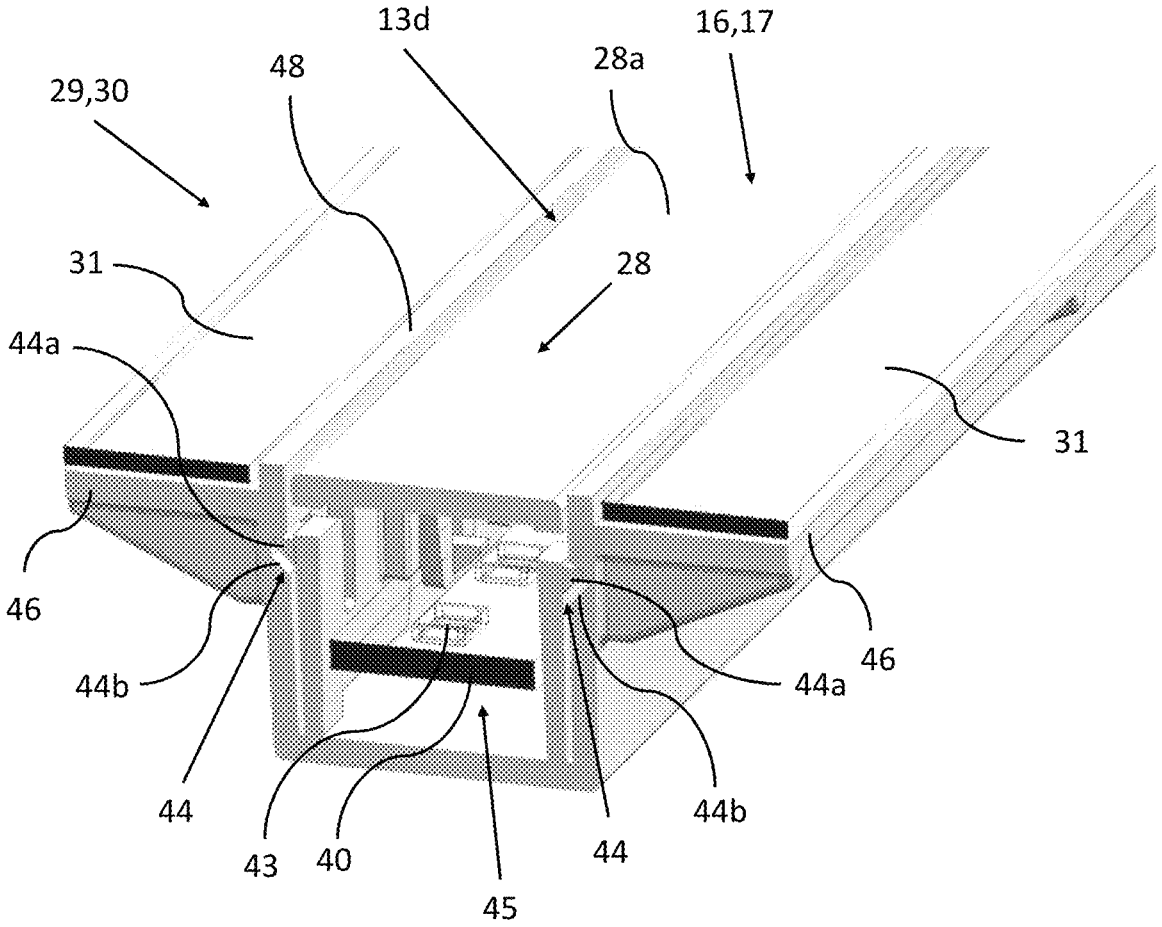
FIG. 8 is a perspective sectional view of the module carrier receiving the light module according to FIG. 6 and FIG. 7.

FIG. 8 shows a perspective sectional view of the module carrier 29, 30 with the light module 16, 17 according to FIG. 6 and FIG. 7. The light module 16, 17 has a light housing 28 with a diffusor 28*a* through which the light emits from the light sources 43 on the circuit board 40. The light housing 28 are fixed in the receiving cavity 45 of the module carrier 29, 30 by fixing structures 44. The fixing structures 44 are formed by the latching structures 44*a* provided on the outer side surface of the light housing 28 and catching structures 44*b* provided on the inner side surface of the receiving cavity 45 of the module carrier 29, 30. The light housing 28 having a bottom wall, which forms the diffusor 28*a*, from which vertical walls rising for forming a pot-shaped cavity, in which the circuit board 40 with the light sources 43 is fixed by snap-fit connections 47. The receiving cavity 45 is accessible through a first opening 13*d*. The module carrier 29, 30 has a circumferential frame 48 that surrounds the first opening 13*d* and protrudes into the first opening 13*d*. The frame can be formed in particular by an end region of the side walls of the receiving cavity 45 of the module carrier 29, 30. The frame 48 surrounds the diffusor 28*a* of the light housing 28 and is consequently placed between the diffusor and a circumferential edge of the first opening 13*d*. Further, the module carrier 29, 30 contains a flange surface 46 on which is arranged an adhesive bond, in particular a first adhesive bond 31. The flange surface 46 of the module carrier 29, 30 completely surrounds the receiving cavity 45 for attaching the module carrier 29, 30 on an inner side 13*e* of the bottom wall 13 by the adhesive bond, especially first adhesive bond 31.

The following is a summary list of reference numerals and the corresponding structure used in the above description of the invention:

| | |
|---|---|
| 1 | household cooling appliance |
| 2 | housing |
| 3 | receiving space |

-continued

| | |
|---|---|
| 3a | upper volume subspace |
| 3b | lower volume subspace |
| 4 | inner liner |
| 5 | outer housing |
| 6 | first vertical sidewall |
| 7 | second vertical sidewall |
| 8 | separation unit |
| 9 | first storage chamber |
| 9a | first storage unit |
| 9b | first closing unit |
| 10 | second storage chamber |
| 10a | second storage unit |
| 10b | second closing unit |
| 11 | base plate |
| 12 | ceiling wall |
| 12a | top side |
| 12b | second bottom side |
| 13 | bottom wall |
| 13a | first fillet |
| 13b | second fillet |
| 13c | third bottom side |
| 13d | first opening |
| 13e | inner side |
| 14 | clearance |
| 15 | thermally insulating material |
| 16 | first light module |
| 17 | second light module |
| 18 | electronics module |
| 19 | operating and/or display device |
| 20 | second opening |
| 21 | first detection sensor |
| 23 | second detection sensor |
| 24 | first transmission unit |
| 24a | first cam shaft |
| 24b | first guiding element |
| 25 | second transmission unit |
| 25a | second cam shaft |
| 25b | second guiding element |
| 26 | front panel |
| 27 | bearing element |
| 28 | light housing |
| 28a | diffusor |
| 29 | first module carrier |
| 30 | second module carrier |
| 31 | first adhesive bond |
| 32 | second adhesive bond |
| 33 | screw connection |
| 34 | cut out |
| 40 | circuit board |
| 40a | electrical connection |
| 41 | electrical connection opening |
| 42 | electrical connection cavity |
| 43 | light source |
| 44 | fixing structure |
| 44a | latching structure |
| 44b | catching structure |
| 45 | receiving cavity |
| 46 | flange surface |
| 47 | snap-fit connection |
| 48 | frame |
| 50 | first retaining element |
| 51 | second retaining element |
| 60 | first drive unit |
| 61 | second drive unit |
| 70 | hole |
| x | width direction |
| y | height direction |
| z | depth direction |

The invention claimed is:

1. A household cooling appliance, comprising:

a housing defining a receiving space for food;

a plate-shaped separation unit being releasably disposed in said receiving space and is disposed for separating a volume of said receiving space, wherein said plate-shaped separation unit has a base plate which has a clearance filled with a thermally insulating material, said plate-shaped separation unit has in said base plate at least one light module configured as a function module, said base plate is configured as a multi-module carrier plate for receiving several functionally different function modules;

an electronics module disposed on said base plate and is separate and functionally different from said at least one light module;

a closing unit which is external to said plate-shaped separation unit; and said electronics module is a drive unit for driving said closing unit.

2. The household cooling appliance according to claim 1, wherein said base plate has a bottom wall with a recess formed therein that is open towards a bottom, wherein said at least one light module is disposed and sunk in said recess such that light of said at least one light module is emitted through a first opening of said recess towards the bottom.

3. The household cooling appliance according to claim 1, wherein:

said base plate has a ceiling wall with a recess formed therein; and said electronics module is a display device, said display device is disposed in said recess of said ceiling wall of said base plate, said ceiling wall is open towards a top and in said ceiling wall said display device is disposed sunk in, such that said display device may be viewed from a top through an second opening of said recess.

4. The household cooling appliance according to claim 3, wherein said ceiling wall is made of glass and has a cut-out formed therein, wherein said electronics module is disposed in said cut-out of said ceiling wall.

5. The household cooling appliance according to claim 3, wherein said display device is an operating and display device for inputting and outputting operating parameters.

6. The household cooling appliance according to claim 1, wherein said base plate has a bottom wall; and further comprising a transmission disposed on said bottom wall of said base plate, said transmission is connected to said drive unit configured for guiding a movement of said closing unit of the household cooling appliance that is external to said plate-shaped separation unit, wherein said closing unit is mechanically coupled to said transmission unit.

7. The household cooling appliance according to claim 6, further comprising a storage chamber with a storage unit; and wherein said closing unit is movable into different positions relative to said storage unit of said storage chamber by said drive unit over said transmission unit, so that different ventilation is provided in said storage chamber.

8. The household cooling appliance according to claim 1, wherein said closing unit is at least partially light permeable for passing light emitted from said at least one light module through said closing unit into said storage chamber, wherein said closing unit is made translucent.

9. The household cooling appliance according to claim 1, further comprising a first module carrier, said at least one light module is disposed on said first module carrier that is disposed sunk in in said clearance.

10. The household cooling appliance according to claim 9, wherein said first module carrier is disposed completely sunk in in said clearance.

11. The household cooling appliance according to claim 1, wherein said at least one light module has a light housing with a cavity formed therein, and a circuit board with at least one light source, wherein said circuit board is received in said cavity formed in said light housing.

12. The household cooling appliance according to claim 1, wherein said base plate has a bottom wall made of metal.

13. The household cooling appliance according to claim 1, wherein said thermally insulating material is polystyrene.

14. The household cooling appliance according to claim 13, wherein said thermally insulating material is a polystyrene board.

15. The household cooling appliance according to claim 1, wherein:

said base plate has a bottom wall with a recess formed therein.

16. The household cooling appliance according to claim 1, further comprising bearing elements disposed on a vertical sidewall of said base plate for bearing said plate-shaped separation unit and are disposed in said receiving space.

17. The household cooling appliance according to claim 16, wherein:

said base plate has a ceiling wall with first and second bottom sides; and said bearing elements are separate parts, which are attached to said second bottom side of said ceiling wall.

18. The household cooling appliance according to claim 17, wherein said bearing elements are separate parts, which are attached to said second bottom side of said ceiling wall by an adhesive bond.

* * * * *